US008620179B2

(12) United States Patent
Hashimoto et al.

(10) Patent No.: US 8,620,179 B2
(45) Date of Patent: Dec. 31, 2013

(54) TANDEM TYPE PHOTOSENSITIVE UNIT AND IMAGE FORMING APPARATUS

(75) Inventors: Junichi Hashimoto, Toyohashi (JP); Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 675 days.

(21) Appl. No.: 12/508,617

(22) Filed: Jul. 24, 2009

(65) Prior Publication Data

US 2010/0028043 A1 Feb. 4, 2010

(30) Foreign Application Priority Data

Jul. 25, 2008 (JP) ..... 2008-192788

(51) Int. Cl.
*G03G 15/00* (2006.01)
*G03G 21/16* (2006.01)

(52) U.S. Cl.
CPC ..... *G03G 21/1609* (2013.01)
USPC ..... 399/111; 399/117; 399/223

(58) Field of Classification Search
USPC ..... 399/98, 107, 110, 111, 116, 117, 119, 399/120, 222, 223, 226, 237
See application file for complete search history.

(56) References Cited

U.S. PATENT DOCUMENTS

| | | | | |
|---|---|---|---|---|
| 6,278,471 | B1 | 8/2001 | Uchiyama et al. | |
| 2001/0031152 | A1 * | 10/2001 | Kaneko et al. | 399/107 |
| 2003/0053819 | A1 | 3/2003 | Nomura et al. | |
| 2003/0068173 | A1 | 4/2003 | Tanizaki et al. | |
| 2005/0180779 | A1 * | 8/2005 | Okamoto | 399/222 |
| 2006/0140673 | A1 | 6/2006 | Kamimura et al. | |
| 2007/0036582 | A1 * | 2/2007 | Okabe | 399/111 |
| 2007/0122175 | A1 | 5/2007 | Sato | |
| 2007/0122176 | A1 | 5/2007 | Sato | |
| 2007/0160382 | A1 * | 7/2007 | Tomatsu | 399/107 |
| 2007/0280729 | A1 | 12/2007 | Murayama | |
| 2009/0220275 | A1 | 9/2009 | Hashimoto | |

FOREIGN PATENT DOCUMENTS

| | | | |
|---|---|---|---|
| JP | 09-054485 | A | 2/1997 |
| JP | 11-174772 | A | 7/1999 |
| JP | 11-344849 | A | 12/1999 |
| JP | 11-344905 | A | 12/1999 |
| JP | 2000-241734 | A | 9/2000 |
| JP | 2001-246807 | A | 9/2001 |
| JP | 2001-296494 | A | 10/2001 |

(Continued)

OTHER PUBLICATIONS

Extended EP Search Report dtd Jan. 15, 2010, EP Appln. 09166342.7.

*Primary Examiner* — Walter L Lindsay, Jr.
*Assistant Examiner* — Jessica L Eley
(74) *Attorney, Agent, or Firm* — Banner & Witcoff, Ltd.

(57) ABSTRACT

A tandem type photosensitive unit includes: a plurality of photosensitive drums arranged in parallel with one another; a first structure member having a side surface extending in an arrangement direction of the photosensitive drums as viewed from an axial direction of the photosensitive drums for collectively retaining the plurality of photosensitive drums and relatively positioning the plurality of photosensitive drums; and a second structure member having a side surface extending in the arrangement direction as viewed from the axial direction for collectively retaining developer cartridges provided correspondingly to the photosensitive drums respectively. The first structure member is fixed to the second structure member on one side in the arrangement direction, and mounted on the second structure member with a clearance on the other side in the arrangement direction.

17 Claims, 11 Drawing Sheets

(56) References Cited

FOREIGN PATENT DOCUMENTS

| | | | |
|---|---|---|---|
| JP | 2003-015378 | A | 1/2003 |
| JP | 2003-295717 | A | 10/2003 |
| JP | 2006-184552 | A | 7/2006 |
| JP | 2007-072422 | | 3/2007 |
| JP | 2007-148286 | A | 6/2007 |
| JP | 2007-148287 | A | 6/2007 |
| JP | 2007-322733 | A | 12/2007 |
| JP | 2009-210630 | A | 9/2009 |

* cited by examiner

TANDEM TYPE PHOTOSENSITIVE UNIT AND IMAGE FORMING APPARATUS

CROSS REFERENCE TO RELATED APPLICATION

This application claims priority to Japanese Patent Application No. 2008-192788 filed on Jul. 25, 2008, the disclosure of which is hereby incorporated into the present application.

TECHNICAL FIELD

The present invention relates to a tandem type photosensitive unit and an image forming apparatus.

BACKGROUND

The so-called tandem type color printer formed by parallelly arranging photosensitive drums corresponding to yellow, magenta, cyan and black respectively is known as an electrophotographic color printer.

The tandem type color printer includes developing rollers opposed to the photosensitive drums respectively. Electrostatic latent images are formed on the surfaces of the photosensitive drums. When the electrostatic latent images are opposed to the developing rollers following rotation of the photosensitive drums, toners are fed from the developing rollers to the electrostatic latent images. Thus, toner images are formed on the surfaces of the photosensitive drums respectively. The toner images of the corresponding colors are formed on the photosensitive drums respectively and overlappingly transferred to a sheet transported by a belt, whereby a color image is formed on the sheet.

A color printer having four photosensitive drums integrally attachable to and detachable from a main body casing is proposed as such a tandem type color printer.

The color printer according to the proposal includes drum subunits retaining the photosensitive drums respectively and a pair of side plates holding the drum subunits from both sides in the axial direction of the photosensitive drums. Developer cartridges retaining the developing rollers are detachably mounted between the side plates correspondingly to the drum subunits respectively. The drum subunits, the developer cartridges and the pair of side plates are detachably mounted on the main body casing as a drum unit.

Both end portions of drum shafts of the photosensitive drums protrude outward from both side surfaces of the drum subunits. Four shaft holes are formed in each side plate at regular intervals in the arrangement direction of the photosensitive drums. End portions of the drum shafts are inserted into the shaft holes respectively, so that the photosensitive drums are positioned.

Each side plate is made of a metal having a relatively low linear expansion coefficient. The side plate (hereinafter referred to as a "metal side plate" in this section) made of a metal has rigidity capable of keeping the relative positional relation between the photosensitive drums constant, while the same is heavier as compared with a side plate (hereinafter referred to as a "resin side plate" in this section) of the same shape made of resin. Further, the metal side plate disadvantageously requires a higher material cost than the resin side plate.

Therefore, each side plate may be formed by fixing a metal side plate and a resin side plate to each other so that the metal side plate retains the photosensitive drums and the resin side plate retains the developer cartridges and the like. According to the structure, the weight of the side plate and the material cost therefor can be reduced due to the partial employment of the resin side plate.

When the temperature around the side plate (the temperature in the color printer) changes, however, a difference in quantity of expansion/contraction is caused between the metal side plate and the resin side plate due to the difference between the linear expansion coefficients of the metal and the resin. When the difference in quantity of expansion/contraction is caused between the metal side plate and the resin side plate, the metal side plate may be deformed following expansion/contraction of the resin side plate, to result in a change (misregistration) of the relative positional relation between the photosensitive drums. Relative misregistration between the photosensitive drums leads to misregistration (color shift) between the toner images of the respective colors on the sheet.

SUMMARY

One aspect of the present invention may provide a tandem type photosensitive unit and an image forming apparatus, each capable of keeping the relative positional relation between a plurality of photosensitive drums constant while allowing reduction in weight and material cost.

The same or different aspect of the present invention may provide a tandem type photosensitive unit detachably mounted in an apparatus body of an image forming apparatus.

The same or different aspect of the present invention may provide an image forming apparatus including an apparatus body and a tandem type photosensitive unit detachably mounted in the apparatus body.

The tandem type photosensitive unit includes: a plurality of photosensitive drums arranged in parallel with one another; a first structure member having a side surface extending in an arrangement direction of the photosensitive drums as viewed from an axial direction of the photosensitive drums for collectively retaining the plurality of photosensitive drums and relatively positioning the plurality of photosensitive drums; and a second structure member having a side surface extending in the arrangement direction as viewed from the axial direction for collectively retaining developer cartridges provided correspondingly to the photosensitive drums respectively. The first structure member is fixed to the second structure member on one side in the arrangement direction, and mounted on the second structure member with a clearance on the other side in the arrangement direction.

DETAILED DESCRIPTION

An embodiment of the present invention is now described with reference to the drawings.

A. Overall Structure of Color Printer

Figure 1:
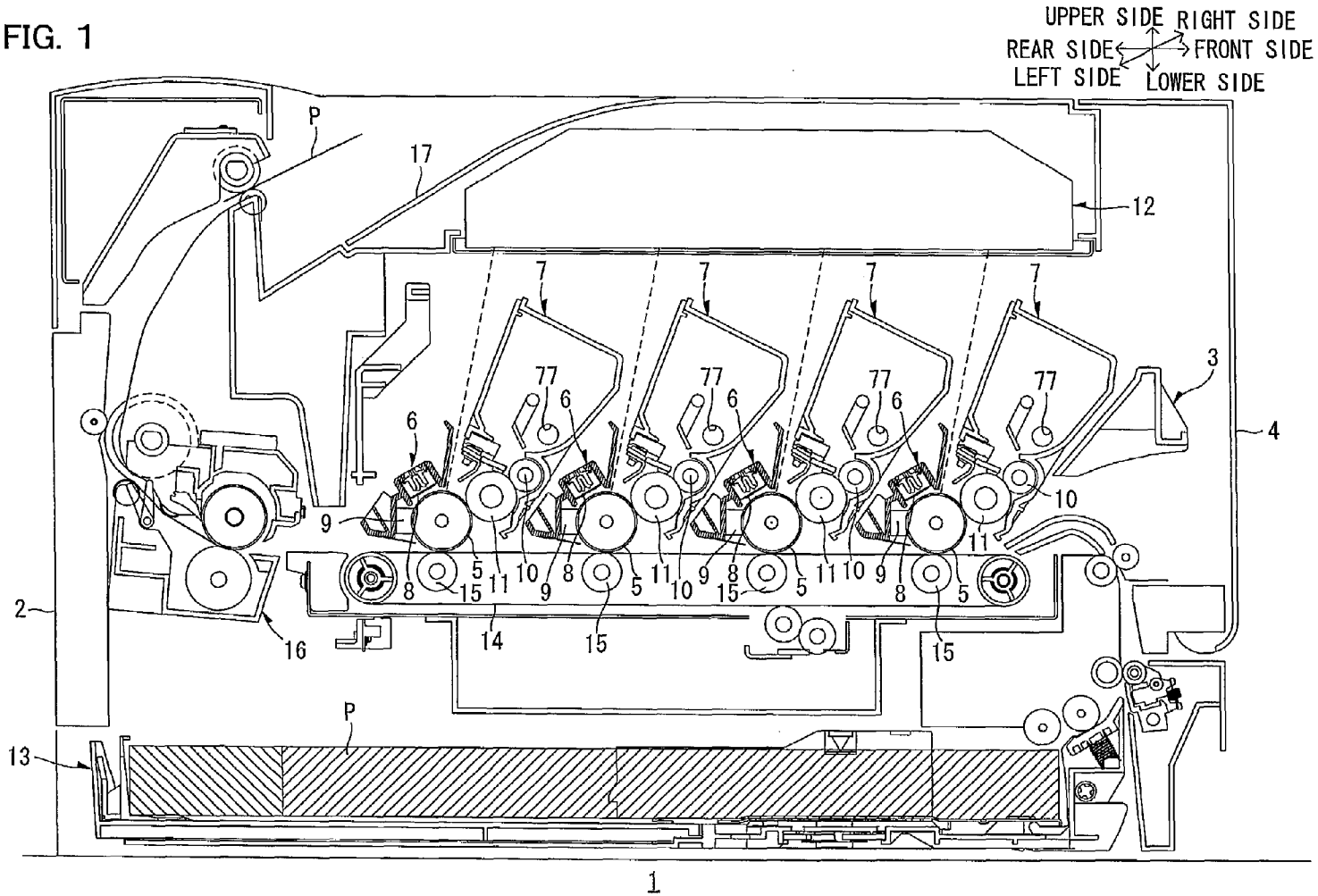
FIG. 1 is a side sectional view of a color printer according to an embodiment of the present invention.

FIG. 1 is a side sectional view of a color printer according to the embodiment of the present invention.

A color printer 1 as an example of an image forming apparatus is a tandem type color printer. A drum unit 3 as an example of a tandem type photosensitive unit is mounted in a main body casing 2 as an example of an apparatus body. The drum unit 3 is attachable to and detachable from the main body casing 2 by opening a front cover 4 provided on one side surface of the main body casing 2.

In the following description, it is assumed that the side (the right side in FIG. 1) provided with the front cover 4 is the front side, and the side (the left side in FIG. 1) opposite hereto is the rear side. The right-and-left direction is defined with reference to the color printer 1 as viewed from the front side. The right-and-left direction is hereinafter referred to as a width direction. The drum unit 3 is described with reference to directions in the state mounted in the main body casing 2, unless otherwise stated.

The drum unit 3 includes a unit frame 19. Four photosensitive drums 5, four drum subunits 6 and four developer cartridges 7 are retained in the unit frame 19.

The photosensitive drums 5 are provided correspondingly to black, yellow, magenta and cyan respectively. The four photosensitive drums 5 are parallelly arranged at regular intervals in the anteroposterior direction in the order of black, yellow, magenta and cyan along the anteroposterior direction.

Each drum subunit 6 is provided correspondingly to each photosensitive drum 5, and arranged at the back of the corresponding photosensitive drum 5. The drum subunit 6 retains a scorotron charger 8 as an example of a charger and a cleaning brush 9.

Each developer cartridge 7 is provided correspondingly to each photosensitive drum 5, and arranged in front of the corresponding photosensitive drum 5. A feed roller 10 and a developing roller 11 are retained in the developer cartridge 7. A toner of each color is accommodated in the developer cartridge 7.

An exposure unit 12 emitting four laser beams corresponding to the respective colors is arranged above the drum unit 3. In place of the exposure unit 12, four LED arrays may be provided correspondingly to the photosensitive drums 5 respectively.

Following rotation of the photosensitive drum 5, the surface of the photosensitive drum 5 is uniformly charged by the scorotron charger 8. Thereafter the charged portion of the surface of the photosensitive drum 5 is selectively exposed by the corresponding laser beam from the exposure unit 12. An electrostatic latent image is formed on the surface of the photosensitive drum 5 due to the exposure. When the electrostatic latent image is opposed to the developing roller 11 following the rotation of the photosensitive drum 5, the toner is fed to the electrostatic latent image from the developing roller 11 through the feed roller 10. Thus, a toner image is formed on the surface of the photosensitive drum 5.

A sheet feeding cassette 13 accommodating sheets P is arranged on the bottom portion of the main body casing 2. Each sheet P accommodated in the sheet feeding cassette 13 is transported onto a transport belt 14 by various rollers. The transport belt 14 is opposed to the four photosensitive drums 5 from below. A transfer roller 15 is arranged on each position opposed to each photosensitive drum 5 through an upper portion of the transport belt 14. The sheet P transported onto the transport belt 14 successively passes through the spaces between the transport belt 14 and the photosensitive drums 5 due to the traveling of the transport belt 14. When opposed to the sheet P, the toner image formed on the surface of each photosensitive drum 5 is transferred to the sheet P by a transfer bias applied to the transfer roller 15.

A fuser 16 is provided on a downstream side of the transport belt 14 in the transport direction for the sheet P. The sheet P having the transferred toner image is transported to the fuser 16. The fuser 16 fixes the toner image to the sheet P by heating and pressurization. The sheet P having the fixed toner image is ejected to a sheet ejection tray 17 provided on the upper surface of the main body casing 2 by various rollers.

B. Drum Unit

Figure 2:
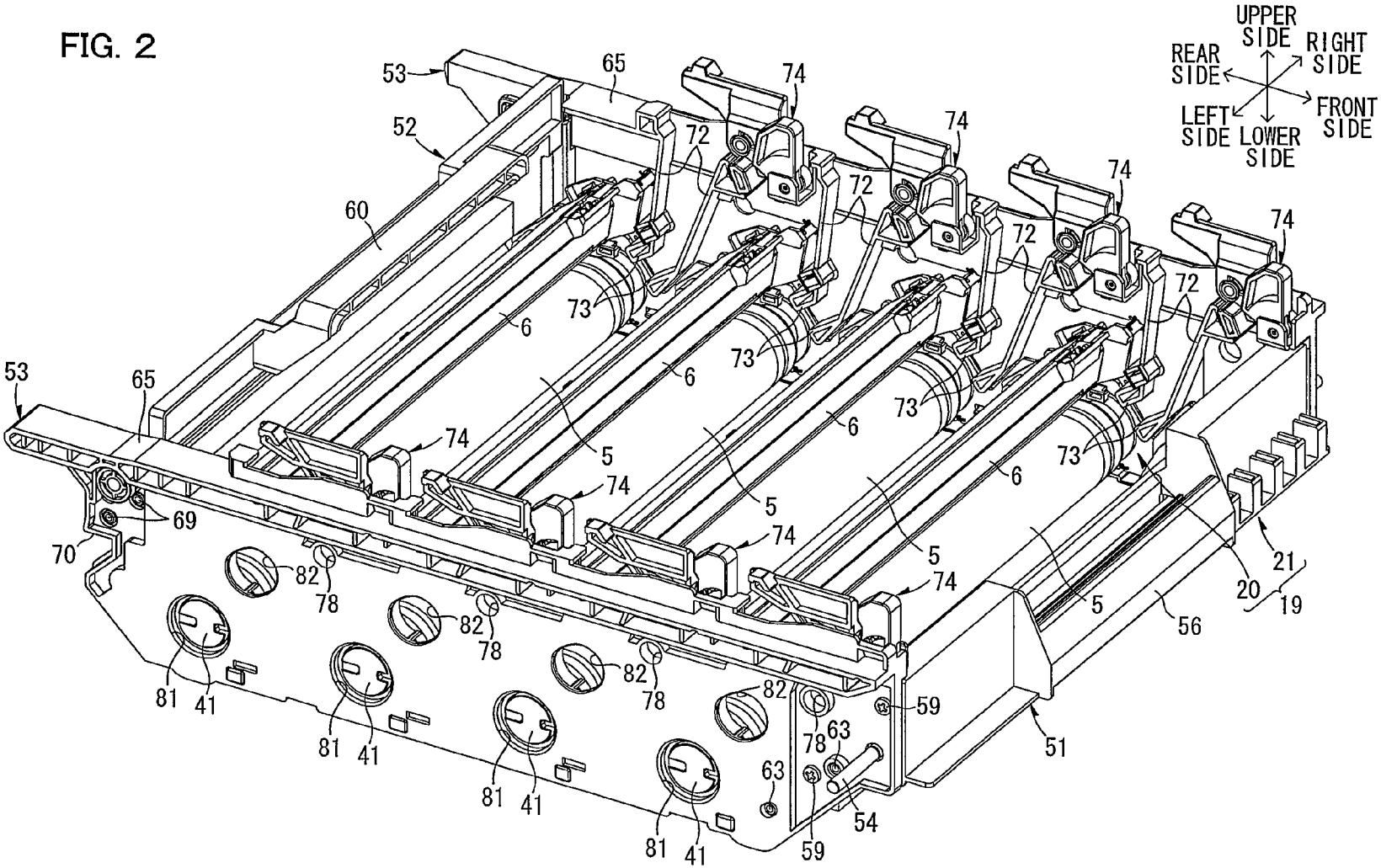
FIG. 2 is a perspective view of the drum unit shown in FIG. 1 as viewed from above the left front side.
Figure 3:
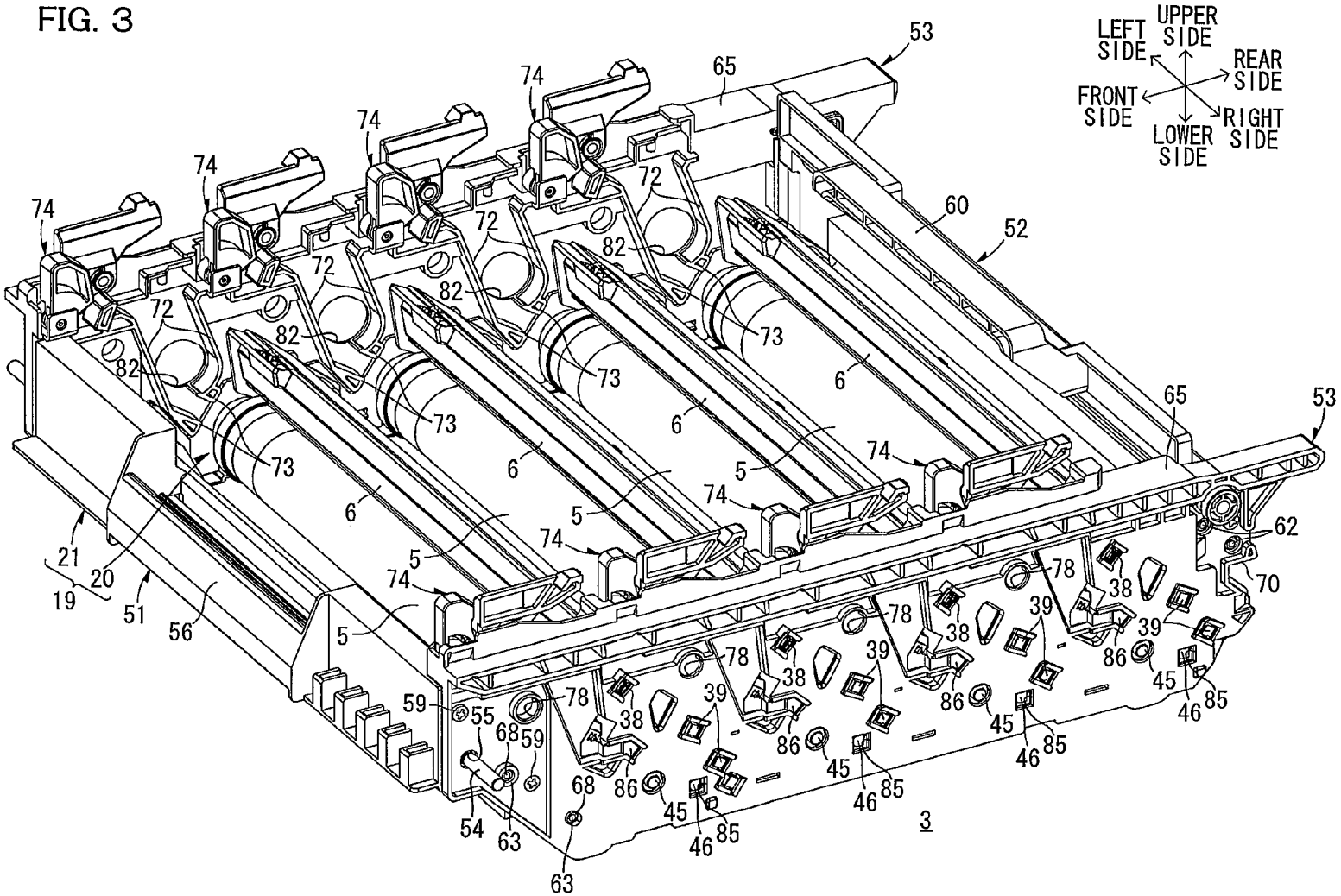
FIG. 3 is a perspective view of the drum unit shown in FIG. 1 as viewed from above the right front side.
Figure 4:
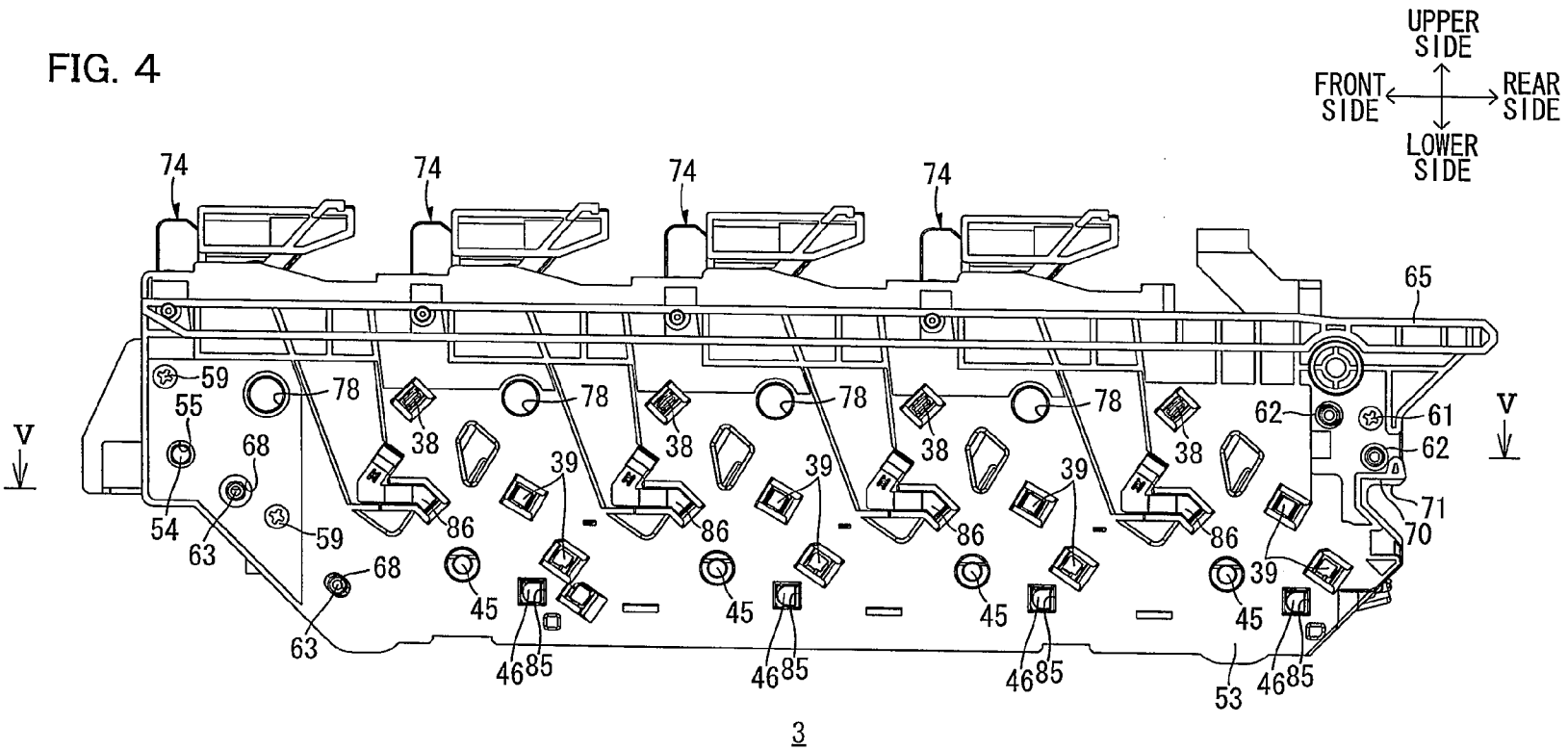
FIG. 4 is a right side elevational view of the drum unit shown in FIG. 1.
Figure 5:
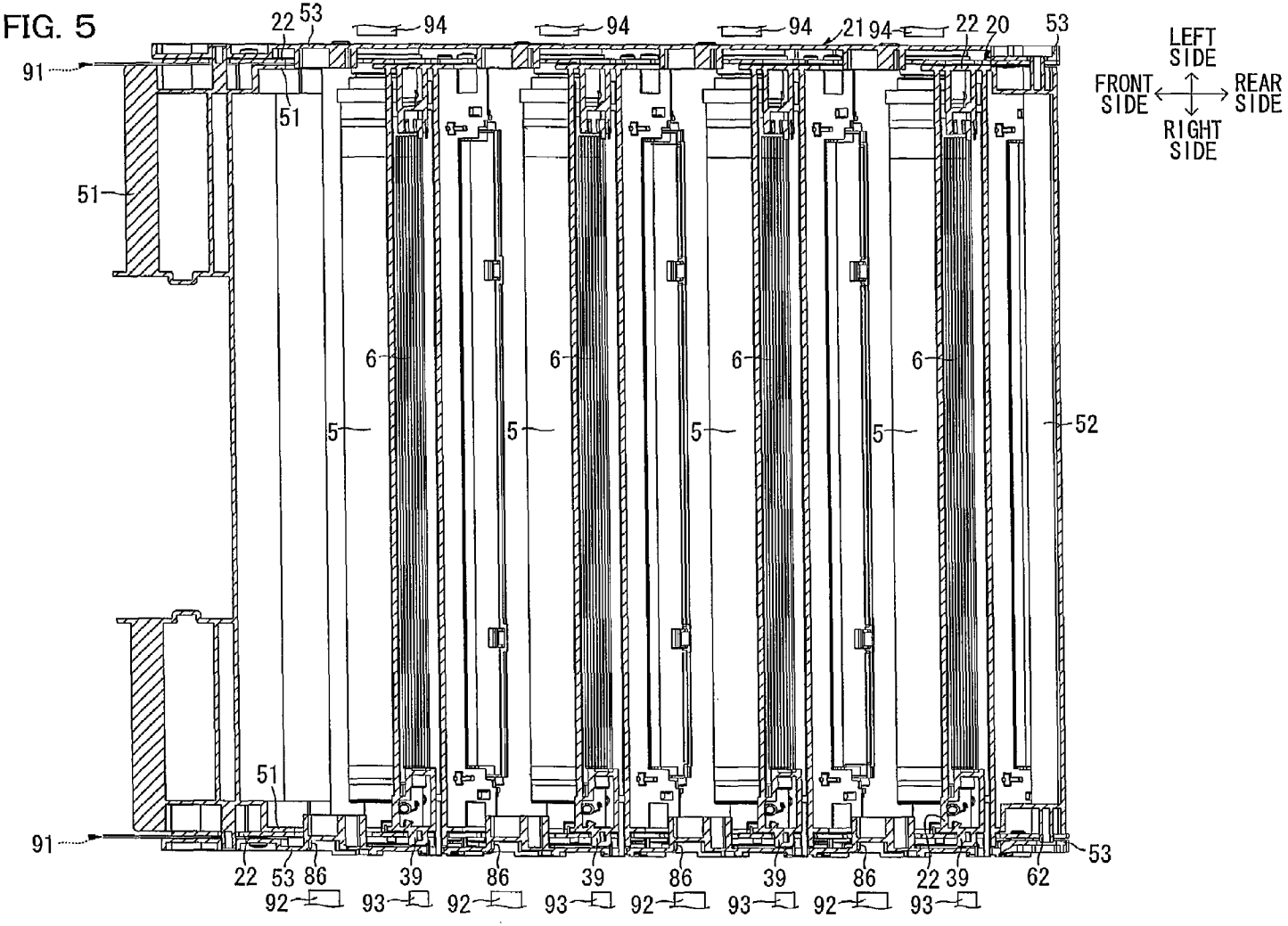
FIG. 5 is a sectional view of the drum unit taken along a line V-V shown in FIG. 4
Figure 6:
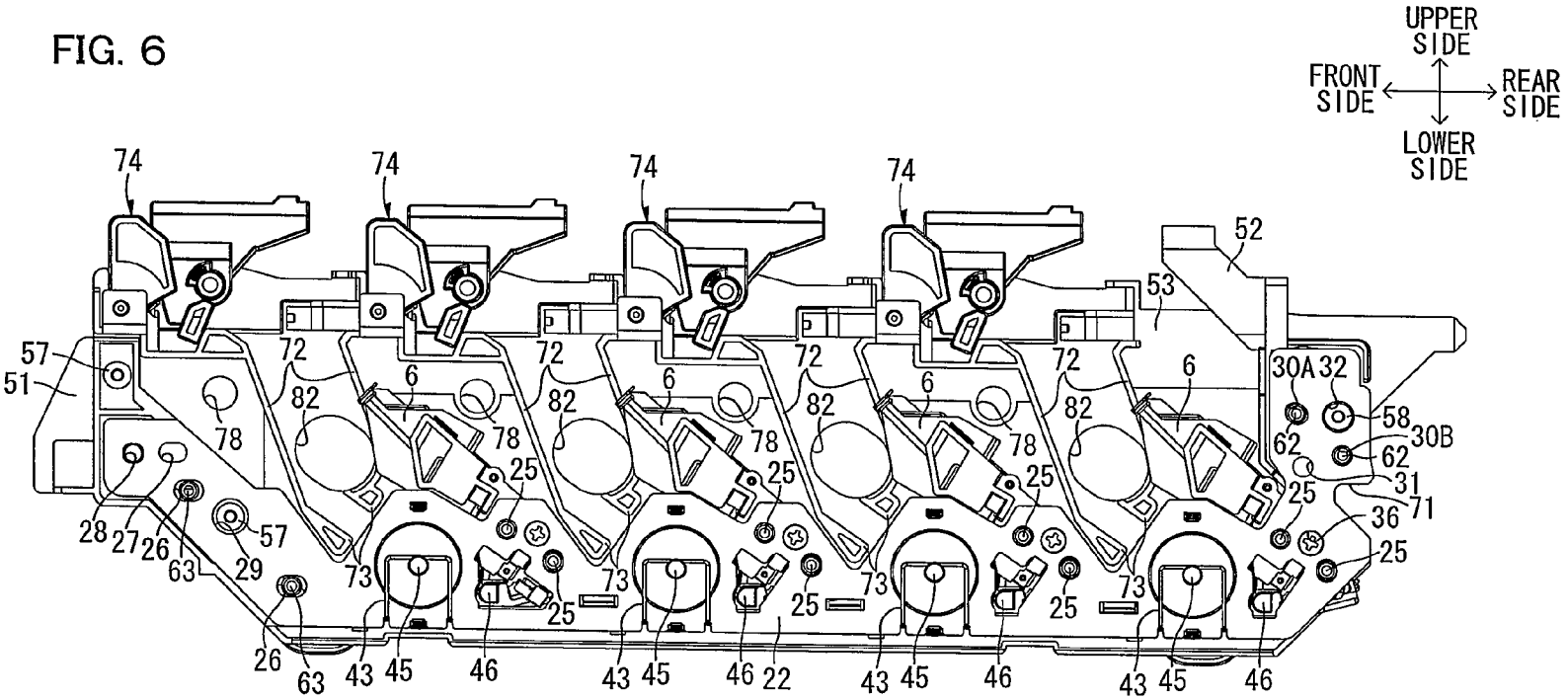
FIG. 6 is a side sectional view of the drum unit shown in FIG. 1 as viewed leftward from an inner side in the axial direction of photosensitive drums.
Figure 7:
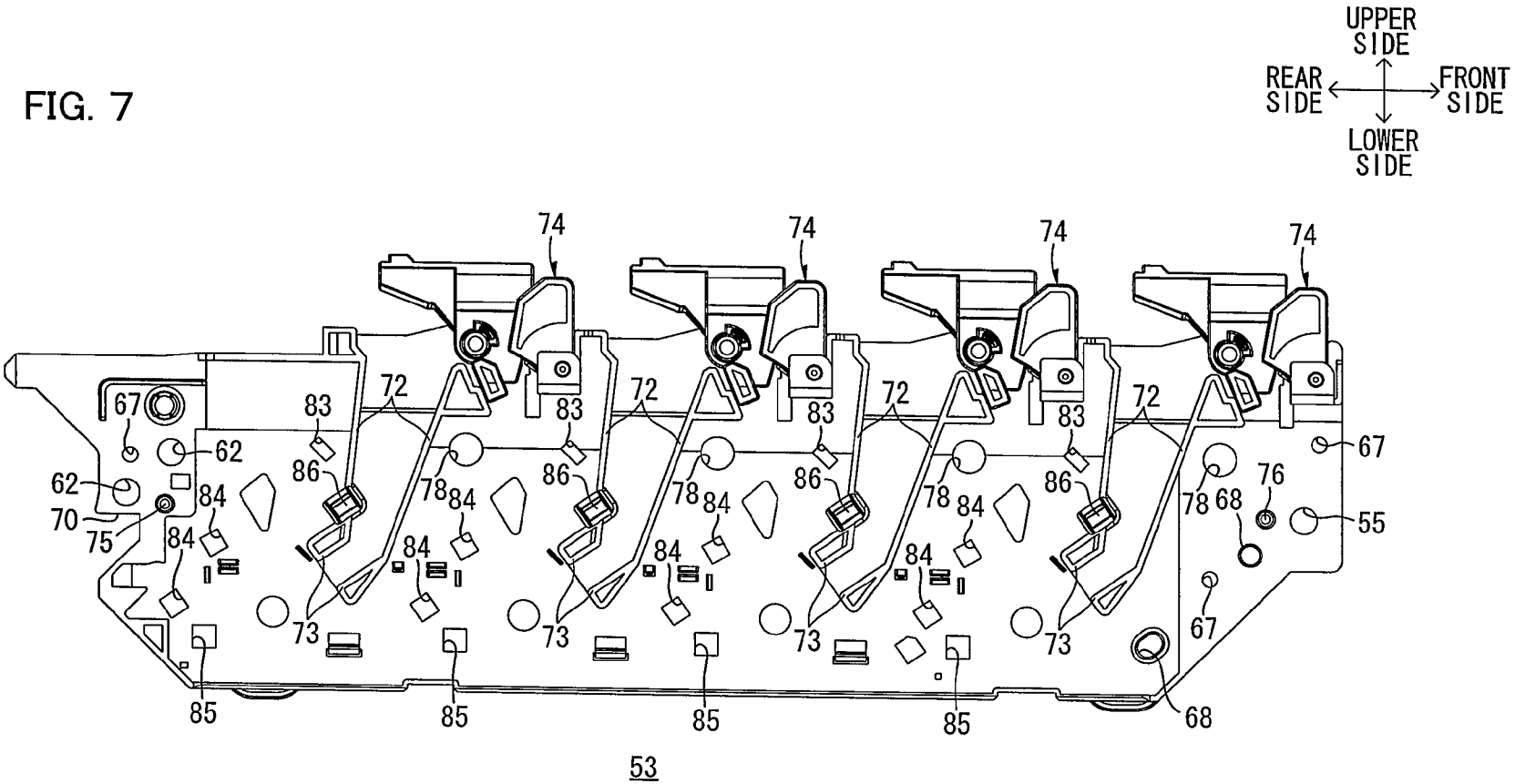
FIG. 7 is a side elevational view of a second structure member shown in FIG. 2 as viewed rightward from the inner side in the axial direction of the photosensitive drums.

FIG. 2 is a perspective view of the drum unit 3 shown in FIG. 1 as viewed from above the left front side. FIG. 3 is a perspective view of the drum unit 3 shown in FIG. 3 as viewed from above the right front side. FIG. 4 is a right side elevational view of the drum unit 3 shown in FIG. 1. FIG. 5 is a sectional view of the drum unit 3 taken along a line V-V shown in FIG. 4. FIG. 6 is a side sectional view of the drum unit 3 shown in FIG. 1 as viewed leftward from an inner side in the axial direction of the photosensitive drums 5. FIG. 7 is a side elevational view of a second structure member shown in FIG. 2 as viewed rightward from the inner side in the axial direction of the photosensitive drums 5.

As shown in FIGS. 2 and 3, the unit frame 19 of the drum unit 3 includes a first structure member 20 and a second structure member 21.

(1) First Structure Member

Figure 8:
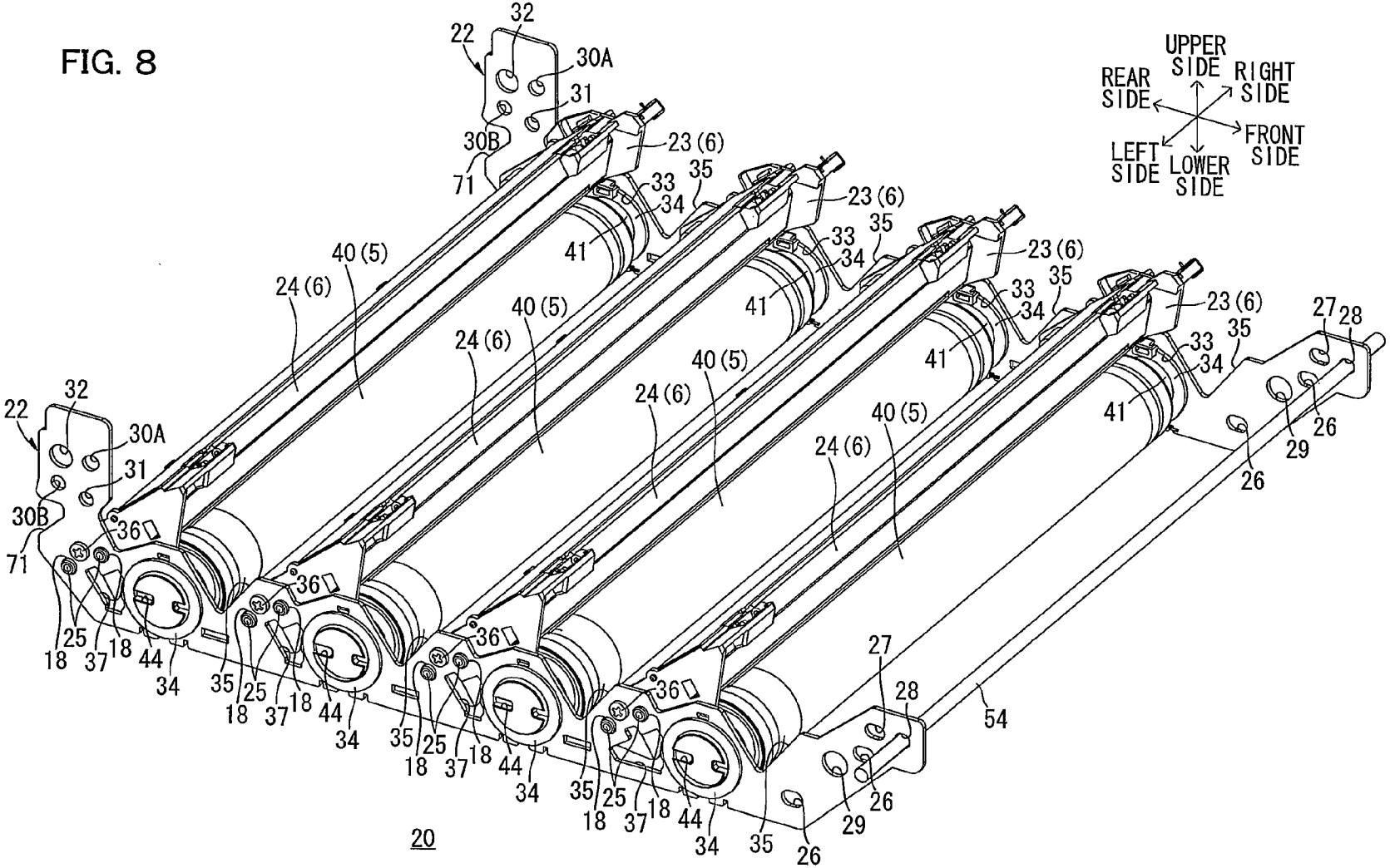
FIG. 8 is a perspective view of the photosensitive drums, drum subunits and a first structure member shown in FIG. 5 as viewed from above the left front side.
Figure 9:
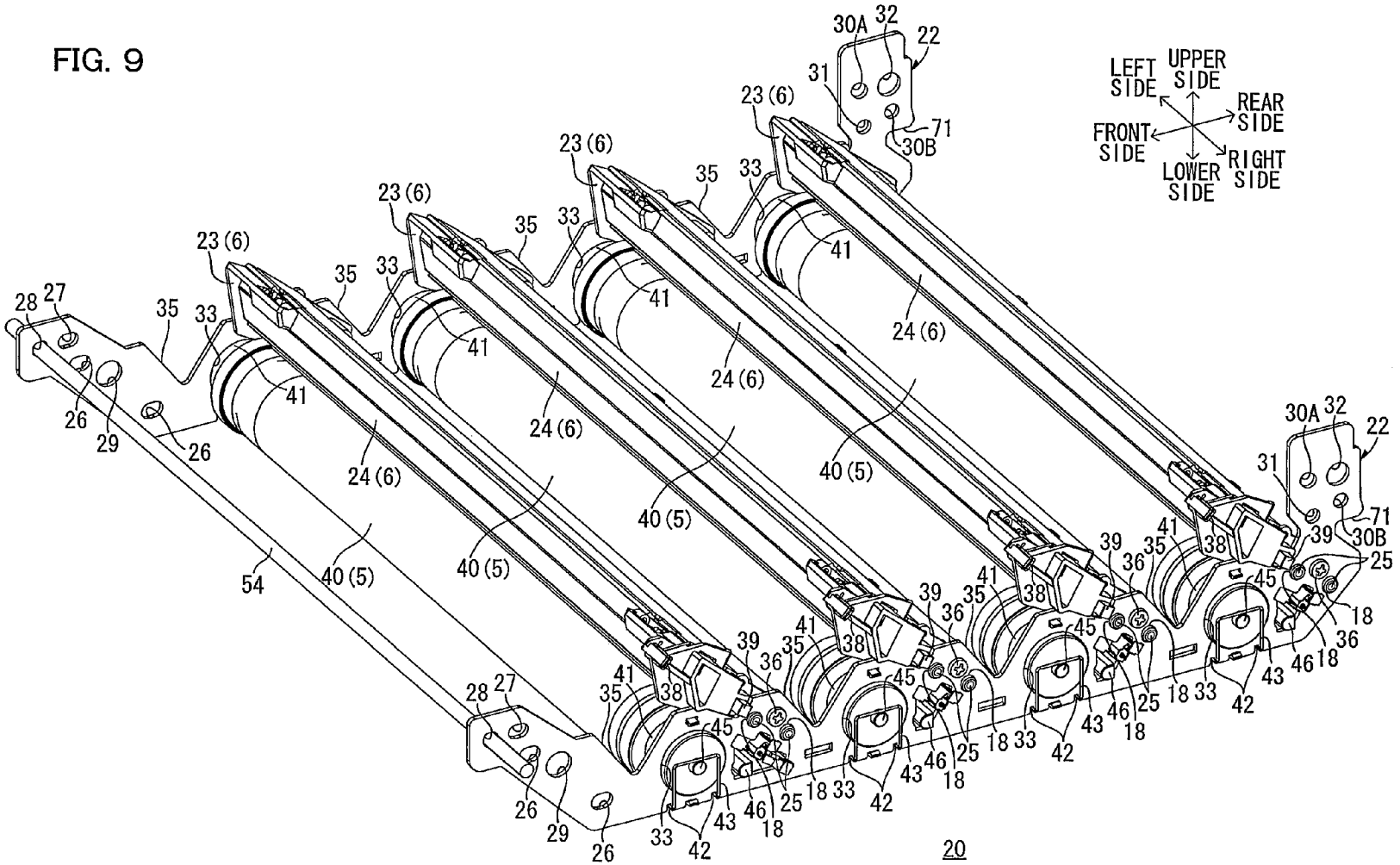
FIG. 9 is a perspective view of the photosensitive drums, the drum subunits and the first structure member shown in FIG. 5 as viewed from above the right front side.

FIG. 8 is a perspective view of the photosensitive drums 5, the drum subunits 6 and the first structure member 20 shown in FIG. 5 as viewed from above the left front side. FIG. 9 is a perspective view of the photosensitive drums 5, the drum subunits 6 and the first structure member 20 shown in FIG. 5 as viewed from above the right front side.

As shown in FIGS. 8 and 9, the first structure member 20 includes a pair of first side plates 22 opposed to each other in the width direction. The four photosensitive drums 5 and the four drum subunits 6 are collectively retained between the pair of first side plates 22.

(1-1) First Side Plate

The right and left first side plates 22 are prepared by press-working metal plates with the same press die, and have the same shapes.

Each first side plate 22 is generally in the form of a long and thin rectangular plate extending in the anteroposterior direction. The front end portion of the first side plate 22 obliquely extends upward toward the front side from the rear side. In the front end portion of the first side plate 22, first boss holes 26 are formed on two positions separated from each other in the extensional direction of the front end portion of the first side plate 22 as slots extending in the anteroposterior direction respectively. A second boss hole 27 is formed above the upper first boss hole 26 as a slot extending in the anteroposterior direction. A support shaft insertion hole 28 is formed in front of the second boss hole 27. A support shaft 54 is inserted into the support shaft insertion hole 28 of each first side plate 22. Thus, the support shaft 54 is extended between the first side plates 22. Further, a boss insertion hole 29 is formed under the rear side of the upper first boss hole 26 as a round hole.

The rear end portion of the first side plate 22 is generally L-shaped in side elevational view. In the rear end portion of the first side plate 22, third boss holes 30A and 30B are formed on two positions separated from each other in a direction inclined frontward. The upper third boss hole 30A is formed as a slot. The lower third boss hole 30B is formed as a round hole. A fourth boss hole 31 is formed on a position under the upper third boss hole 30A in front of the lower third boss hole 30B as a round hole. A connection boss hole 32 is formed on a position at the back of the upper third boss hole 30A above the lower third boss hole 30B as a round hole.

Four circular drum retaining holes 33 are formed in an intermediate portion (between the front end portion and the rear end portion) of the first side plate 22. The drum retaining holes 33 are formed at regular intervals from one another in the anteroposterior direction between the front end portion and the rear end portion of the first side plate 22. A ring-shaped shaft receiving member 34 is fitted in each drum retaining hole 33 in a relatively unrotatable manner.

A developer receiving groove 35 is formed on a position above the front side of each drum retaining hole 33 by notching the upper edge generally in the form of a triangle in side elevational view. The developer receiving groove 35 receives the lower end portion of the corresponding developer cartridge 7 when the developer cartridge 7 is mounted on the drum unit 3 (the second structure member 21).

A triangle hole 37 generally triangular in side elevational view is formed on a position in front of each drum retaining hole 33. An antistatic light passing member 46 is inserted into each triangle hole 37, as shown in FIG. 9. The antistatic light passing member 46 is a bar member generally semicircular in side elevational view, and extends parallelly to the axis of rotation of the corresponding photosensitive drum 5.

Above the rear side of each triangle hole 37, boss holes 18 are formed on positions separated from each other in a direction inclined upward respectively.

An engaging groove 42 is formed under each drum retaining hole 33 by notching the first side plate 22 from the lower edge. A free end portion of a clipping member 43 described later is engaged with the engaging groove 42.

(1-2) Drum Subunit

The drum subunits 6 are extended between the pair of first side plates 22, as shown in FIGS. 8 and 9. Each drum subunit 6 includes a pair of side frames 23 opposed to each other at an interval in the width direction and a center frame 24 extended between the side frames 23.

Each side frame 23 is made of resin, and generally in the form of a triangular plate in side elevational view. Two bosses 25 are formed on the side frame 23 to protrude outward in the width direction. The two bosses 25 are engaged with the boss holes 18 formed on the position of each first side plate 22 opposed to the side frame 23 respectively. Thus, the drum subunit 6 is positioned with respect to the first side plate 22, and fixed to the first side plate 22 with a screw 36 in this state.

As shown in FIG. 9, the right side frame 23 is provided with a wire electrode 38 and a grid electrode 39 as examples of charging electrodes for feeding power to the scorotron charger 8. The wire electrode 38 and the grid electrode 39 protrude rightward from the right side surface of the side frame 23, and are connected to main-body-side charging electrodes 93 provided in the main body casing 2 described later when the drum unit 3 is mounted in the main body casing 2.

The center frame 24 is made of resin, and molded into a rectangle long and thin in the width direction in plan view. The scorotron charger 8 and the cleaning brush 9 for cleaning the surface of the corresponding photosensitive drum 5 are retained in the center frame 24, as shown in FIG. 1.

The drum subunits 6 are extended between the pair of first side plates 22, whereby a ladder-type structure is formed by the first side plates 22 and the four drum subunits 6.

(1-3) Photosensitive Drum

The photosensitive drums 5 are extended between the pair of first side plates 22, as shown in FIGS. 8 and 9. Each photosensitive drum 5 includes a cylindrical drum main body 40 and two flange members 41 fitted with both end portions of the drum main body 40 to be relatively unrotatable respectively.

The outermost layer of the drum main body 40 is formed by a positively charged photosensitive layer.

The flange members 41 are made of a resin material. The flange members 41 are partially inserted into both end portions of the drum main body 40. In the left flange member 41, a passive groove 44 is formed in an outer (left) end surface in the axial direction of the photosensitive drum 5. A drum driving force input portion 94 provided in the main body casing 2 described later is connected to the passive groove 44 when the drum unit 3 is mounted in the main body casing 2.

An earth shaft 45 extending from the right shaft receiving member 34 passes through the right flange member 41 in the width direction, as shown in FIG. 9. The earth shaft 45 is in contact with an earth plate (not shown). The clipping member 43 made of a metal is engaged with the right end portion of the earth shaft 45. The clipping member 43 is U-shaped in side elevational view, and each free end portion thereof is engaged with the engaging groove 42 of the first side plate 22. Thus, the photosensitive drum 5 is earthed through the earth shaft 45 and the clipping member 43.

The right and left flange members 41 are supported by the right and left shaft receiving members 34 to be rotatable with respect to the first side plates 22.

(2) Second Structure Member

Figure 10:
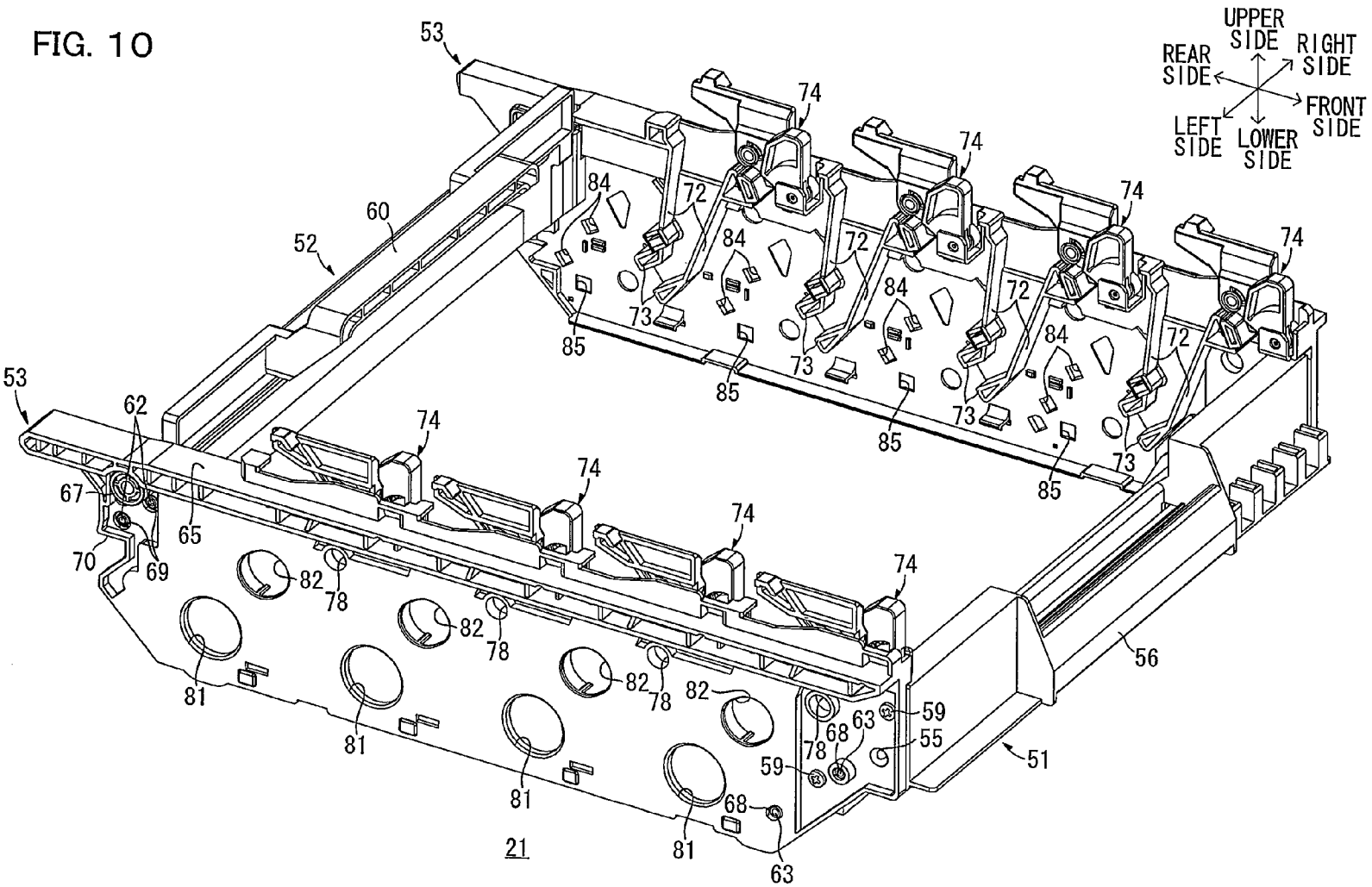
FIG. 10 is a perspective view of the second structure member shown in FIG. 2 as viewed from above the left front side.
Figure 11:
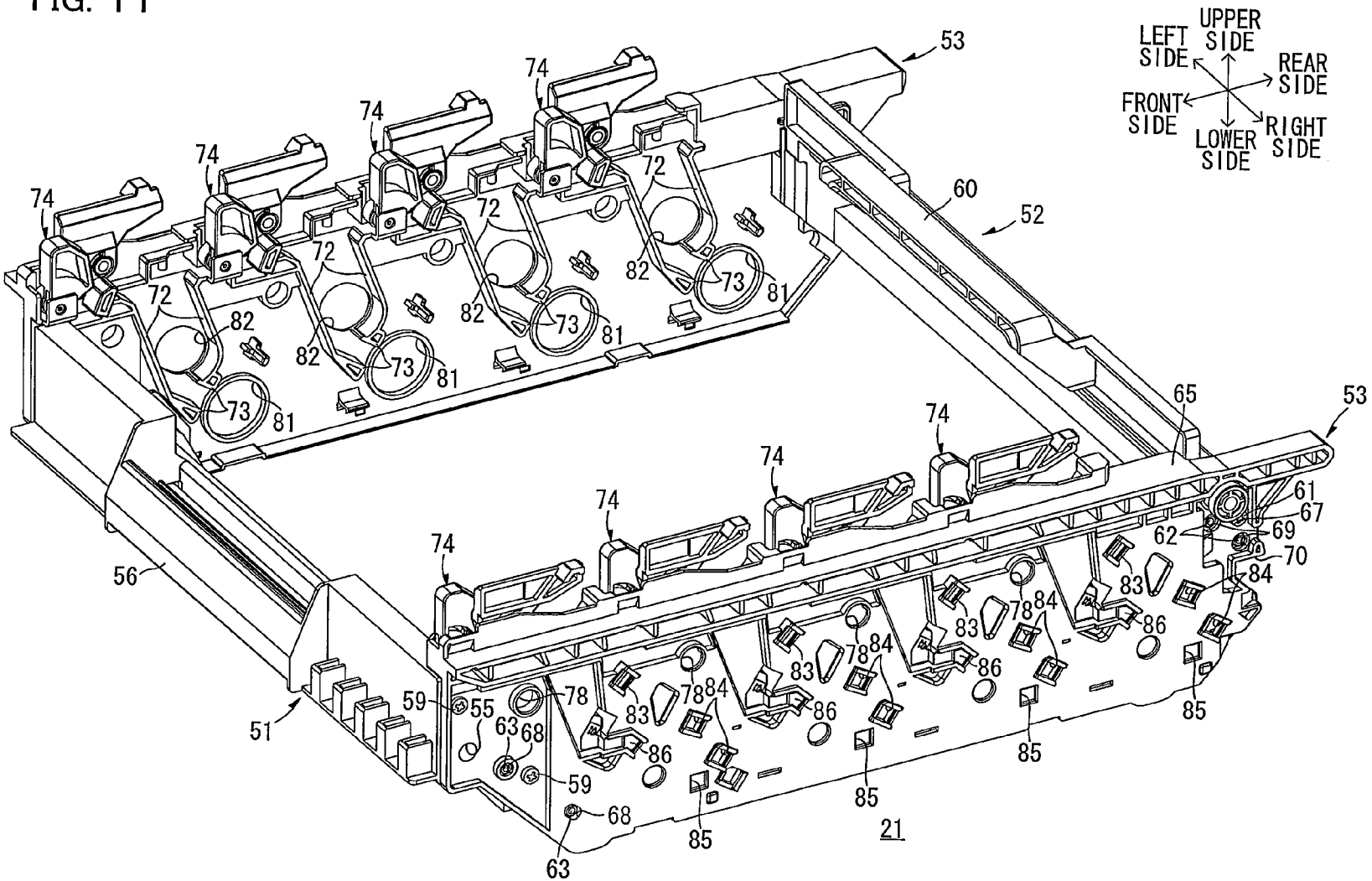
FIG. 11 is a perspective view of the second structure member shown in FIG. 3 as viewed from above the right front side.

FIG. 10 is a perspective view of the second structure member 21 shown in FIG. 2 as viewed from above the left front side. FIG. 11 is a perspective view of the second structure member 21 shown in FIG. 3 as viewed from above the right front side.

The second structure member 21 includes a front beam 51 as an example of a second beam member, a rear beam 52 as an example of a first beam member and a pair of right and left second side plates 53, and is in the form of a quadrangular frame. The four developer cartridges 7 are collectively retained by the second structure member 21.

(2-1) Front Beam

The front beam 51 is made of resin. The front beam 51 is extended between the front end portions of the pair of second side plates 53, as shown in FIGS. 10 and 11.

A front-side grasp portion 56 is integrally formed on the central portion of the front beam 51 in the width direction.

In each side surface of the front beam 51 in the width direction, cylindrical connection bosses 57 are formed on two positions separated from each other in a direction inclined frontward to protrude outward in the width direction respectively, as shown in FIG. 6. Each connection boss 57, having an outer diameter smaller than the boss insertion hole 29 of each first side plate 22, is inserted into the boss insertion hole 29.

In each side surface of the front beam 51 in the width direction, further, cylindrical first side plate bosses 63 are formed on two positions separated from each other in the direction inclined frontward to protrude outward in the width direction respectively. Each first side plate boss 63 has a diameter smaller than the width of each first boss hole 26 of the first side plate 22 in a short-side direction (the vertical direction).

The first side plate boss 63 is inserted into each first boss hole 26 of the first side plate 22. The first side plate boss 63 is cylindrically formed while the first boss hole 26 is formed as a slot extending in the anteroposterior direction, whereby the first side plate boss 63 has a clearance with respect to the first boss hole 26 in the anteroposterior direction.

(2-2) Rear Beam

The rear beam 52 is made of resin. The rear beam 52 is extended between the rear end portions of the pair of second side plates 53, as shown in FIGS. 10 and 11.

A back-side grasp portion 60 generally U-shaped in rear elevational view is integrally formed on the central portion of the rear beam 52 in the width direction.

In each side surface of the rear beam 52 in the width direction, a connection boss 58 is formed to protrude outward in the width direction, as shown in FIG. 6. The connection boss 58 is in the form of a cylinder having a diameter smaller than the inner diameter of the connection boss hole 32 of the first side plate 22.

In each side surface of the rear beam 52 in the width direction, further, first side plate bosses 62 are formed on two positions separated from each other in a direction inclined frontward, to protrude outward in the width direction respectively. The first side plate bosses 62 are in the form of cylinders having outer diameters generally identical to the inner diameters of the third boss holes 30A and 30B of the first side plate 22. The first side plate bosses 62 are inserted into the third boss holes 30A and 30B of the first side plate 22 respectively.

(2-3) Second Side Plate

Each second side plate 53 is made of fiber-reinforced resin, for example. The second side plate 53 is generally in the form of a long and thin rectangular plate having a larger width in the vertical direction and a generally identical length in the anteroposterior direction as compared with the first side plate 22, as shown in FIG. 6. The front end portion and the rear end portion of the second side plate 53 are opposed to the front beam 51 and the rear beam 52 respectively, as shown in FIGS. 10 and 11.

A flange portion 65 extending outward in the width direction is formed on the upper end portion of the second side plate 53 over the anteroposterior direction. The flange portion 65 slidably comes into contact with a roller member (not shown) provided in the main body casing 2 from above. Thus, the second structure member 21 (the drum unit 3) can be smoothly introduced into and discharged from the main body casing 2.

A detection light passing hole 78 is formed in the second side plate 53 penetratingly in the width direction on a position opposed to a detection window 77 (see FIG. 1) formed on the side surface of each developer cartridge 7 (see FIG. 1) when each developer cartridge 7 is mounted on the second structure member 21 (the drum unit 3).

In the front end portion of the second side plate 53, first boss holes 68 are formed on positions opposed to the first side plate bosses 63 of the front beam 51 in the width direction respectively, as shown in FIG. 7. The upper first boss hole 68 is formed as a round hole. The lower first boss hole 68 is formed as a slot extending upward toward the front side. The first side plate bosses 63 of the front beam 51 are inserted into the first boss holes 68, so that the front beam 51 is positioned with respect to the second side plate 53.

In the front end portion of the second side plate 53, further, screw holes 67 are formed on positions opposed to the connection bosses 57 (see FIG. 6) of the front beam 51 in the width direction respectively. Screws 59 are inserted into the screw holes 67 from outside in the width direction and meshed with the connection bosses 57 of the front beam 51, so that the front beam 51 is fixed to the second side plate 53. In the front end portion of the second side plate 53, a support shaft insertion hole 55 receiving the support shaft 54 (see FIGS. 8 and 9) is further formed under the upper screw hole 67.

In the inner side surface of the second side plate 53, a first side plate boss 75 is provided on a position opposed to the fourth boss hole 31 of the first side plate 22 in the width direction, to protrude inward in the width direction. In the inner side surface of the second side plate 53, further, a first side plate boss 76 is provided on a position opposed to the second boss hole 27 of the first side plate 22 in the width direction, to protrude inward in the with direction.

In the rear end portion of the second side plate 53, a screw hole 67 is formed on a position opposed to the connection boss 58 (see FIG. 6) of the rear beam 52 in the width direction, as shown in FIG. 7. A screw 61 is inserted into the screw hole 67 from outside in the width direction and meshed with the corresponding connection boss 57 of the rear beam 52, so that the rear beam 52 is fixed to the second side plate 53.

In the rear end portion of the second side plate 53, further, a notch portion 70 is formed by generally triangularly notching the same from the rear edge thereof. Correspondingly to the notch portion 70, a notch portion 71 (see FIG. 6) generally identical in shape to the notch portion 70 is formed on a position of the rear end portion of the first side plate 22 overlapping with the notch portion 70 of the second side plate 53 when the drum unit 3 is assembled. When the drum unit 3 is mounted in the main body casing 2, the notch portion 71 receives a main body reference shaft (not shown) provided on the main body casing 2, and comes into contact with the main body reference shaft from above and from the front side.

On the inner side surface of the second side plate 53 in the width direction (the right side surface of the left second side plate 53 or the left side surface of the right second side plate 53), four cartridge guide portions 72 for guiding attachment and detachment of the developer cartridges 7 between the right and left second side plates 53 are formed at regular intervals from one another in the anteroposterior direction. Each cartridge guide portion 72 is formed by two protrusions protruding from the inner side surface of the second side plate 53 inward in the width direction at an interval from each other. The cartridge guide portion 72 is inclined from the upper end portion of the second side plate 53 downward toward the rear side with a constant gradient.

A cartridge retaining portion 73 is integrally formed on the lower end portion of the cartridge guide portion 72. The cartridge retaining portion 73 is formed parallelly to a line connecting the center of the corresponding photosensitive drum 5 and the corresponding developing roller 11, and the lower end portion thereof is opened toward a position for mounting the photosensitive drum 5. The lower edge of the cartridge guide portion 72 is opposed to the developer receiving groove 35 of the first side plate 22 in the width direction.

On the upper end portion of the inner side surface of the second side plate 53, a cartridge pressing member 74 for pressing the developer cartridge 7 downward is provided at the back of each cartridge guide portion 72.

(2-3-1) Left Second Side Plate

The left second side plate 53 is provided with drum coupling insertion holes 81 exposing the left end portions of the photosensitive drums 5 in the axial direction respectively, as shown in FIG. 10.

Four such drum coupling insertion holes 81 are formed on the lower end portion of the second side plate 53 at intervals from one another along the anteroposterior direction. Each drum coupling insertion hole 81 is formed as a round hole passing through the second side plate 53 in the width direction on a position opposed to the left end portion of each photosensitive drum 5 in the axial direction and the corresponding drum retaining hole 33 provided in the first side plate 22, and opposed to the drum driving force input portion 94 (see FIG. 5) provided in the main body casing 2 described later. The drum coupling insertion hole 81 has a diameter greater than the outer diameter of the flange member 41 (see FIG. 8) and smaller than the outer diameter of the left shaft receiving member 34 (see FIG. 8).

In the left second side plate 53, further, developer coupling insertion holes 82 are formed on intermediate portions of the cartridge guide portions 72 in the vertical direction respectively. When each developer cartridge 7 is mounted between the right and left second side plates 53, a coupling passive gear (not shown) provided on the left side surface of the developer cartridge 7 is opposed to each developer coupling insertion hole 82.

(2-3-2) Right Second Side Plate

The right second side plate 53 is provided with four wire electrode openings 83, four grid electrode openings 84, four antistatic light passing holes 85 and four developing electrodes 86, as shown in FIGS. 7 and 11.

Each wire electrode opening 83 is arranged above the upper end surface of the first side plate 22 (see FIG. 6) at the back of the upper end portion of the corresponding cartridge guide portion 72. The wire electrode 38 (see FIG. 9) for feeding power to a wire electrode of the scorotron charger 8 (see FIG. 1) is opposed to the wire electrode opening 83. The wire electrode opening 83 exposes the wire electrode 38.

Each grid electrode opening 84 is arranged at the back of the lower end portion of each cartridge guide portion 72. The grid electrode 39 for feeding power to a grid electrode of the scorotron charger 8 (see FIG. 1) is opposed to the grid electrode opening 84. The grid electrode opening 84 exposes the grid electrode 39.

Each antistatic light passing hole 85 is arranged obliquely under the rear side of each grid electrode opening 84. The antistatic light passing hole 85 is formed as an angular hole passing through the right second side plate 53 in the width direction on a position opposed to the antistatic light passing member 46 (see FIG. 3). Antistatic light emitted from an antistatic lamp (not shown) provided outside the drum unit 3 passes through the antistatic light passing hole 85 and is fed to the peripheral surface of the photosensitive drum 5 through the antistatic light passing member 46 (see FIG. 9), whereby the peripheral surface of the photosensitive drum 5 is exposed, and positive charges remaining on the peripheral surface of the photosensitive drum 5 are eliminated.

Each developing electrode 86 is provided in front of each cartridge guide portion 72, on a position opposed to a cartridge electrode (not shown) provided on the side surface of each developer cartridge 7 in the width direction when each developer cartridge 7 is mounted on the drum unit 3. Each main-body-side developing electrode 92 (see FIG. 5) provided in the main body casing 2 described later is connected to the developing electrode 86. Thus, electric conduction between the cartridge electrode and the main-body-side developing electrode 92 can be attained through the developing electrode 86.

C. Connecting Structure of First Structure Member and Second Structure Member

The first structure member 20 is arranged inside a frame body constituted of the pair of second side plates 53 of the second structure member 21, the front beam 51 and the rear beam 52.

More specifically, the front end portion and the rear end portion of each first side plate 22 are arranged on positions opposed to the front beam 51 and the rear beam 52 in the width direction respectively, as shown in FIG. 6.

The first side plate bosses 63 of the front beam 51 are inserted into the first boss holes 26 of the first side plates 22 with clearances in the anteroposterior direction. The front end portions of the first side plate bosses 63 are inserted into the first boss holes 68 of each second side plate 53, as hereinabove described. Further, the support shaft 54 (see FIGS. 2 and 3) is inserted into the support shaft insertion holes 28 of the first side plates 22. In addition, the connection bosses 57 are inserted into the boss insertion holes 29 of the first side plates 22 with clearances.

On the other hand, the first side plate bosses 62 of the rear beam 52 are inserted into the third boss holes 30A and 30B of the first side plates 22. Further, the connection bosses 58 are inserted into the connection boss holes 32 of the first side plates 22.

As shown in FIG. 5, the second side plates 53 of the second structure member 21 are arranged to hold the first side plates 22 therebetween from outside in the width direction. The first side plate boss 75 (see FIG. 7) of each second side plate 53 is engaged with the fourth boss hole 31 (see FIG. 6) of each first side plate 22 with no clearance. The first side plate boss 76 (see FIG. 7) of each second side plate 53 is engaged with the second boss hole 27 (see FIG. 6) of each first side plate 22 with a clearance in the anteroposterior direction.

Thus, the rear end portion of the first side plate 22 (the first structure member 20) is fixed to the rear beam 52 and the second side plate 53 (the second structure member 21), while the front end portion of the first side plate 22 is mounted on the front beam 51 and the second side plate 53 with a clearance in the anteroposterior direction in a state positioned in the vertical direction.

As shown in FIG. 5, the rear end portion of the first side plate 22 is fixed in a state held between the second side plate 53 and the rear beam 52 from the width direction. On the other hand, a gap 91 is formed between the front end portion of the right first side plate 22 and the corresponding second side plate 53 in the width direction, while a gap 91 is formed between the front end portion of the left first side plate 22 and the front beam 51 in the width direction.

D. Internal Structure of Main Body Casing

As shown in FIG. 5, main-body-side developing electrodes 92 as examples of a pressing member, the main-body-side charging electrodes 93 as examples of the pressing member and the drum driving force input portions 94 are provided in the main body casing 2. The main-body-side developing electrodes 92, the main-body-side charging electrodes 93 and the drum driving force input portions 94 are enabled to approach to and separate from the drum unit 3 when the drum unit 3 is mounted in the main body casing 2.

Each main-body-side developing electrode 92 is arranged to be opposed to each developing electrode 86 provided on the right second side plate 53 of the second structure member 21 from the right side when the drum unit 3 is mounted in the main body casing 2. When the drum unit 3 is mounted in the main body casing 2, the main-body-side developing electrode 92 advances leftward toward each developing electrode 86, and is connected to the developing electrode 86. Thereafter the main-body-side developing electrode 92 further advances leftward, thereby pressing the second structure member 21 leftward through the developing electrode 86. Thus, the second structure member 21 is positioned in the width direction.

Each main-body-side charging electrodes 93 is arranged to be opposed to the wire electrode 38 and the grid electrode 39 provided on the right side frame 23 of each drum subunit 6 of the first structure member 20 from the right side when the drum unit 3 is mounted in the main body casing 2. When the drum unit 3 is mounted in the main body casing 2, the main-body-side charging electrode 93 advances leftward toward the wire electrode 38 and the grid electrode 39, and is electrically connected to the wire electrode 38 and the grid electrode 39. Thereafter the main-body-side charging electrode 93 further advances leftward, thereby pressing the first structure member 20 leftward through the drum subunit 6. Thus, the first structure member 20 is positioned in the width direction.

Each drum driving force input portion 94 is arranged to be opposed to the left flange member 41 (see FIGS. 8 and 9) of each photosensitive drum 5 when the drum unit 3 is mounted in the main body casing 2. When the drum unit 3 is mounted in the main body casing 2, the drum driving force input portion 94 advances rightward toward the flange member 41, and is connected to the passive groove 44 (see FIG. 8) of the flange member 41. Thus, driving force can be transmitted to the photosensitive drum 5.

In order to mount the drum unit 3 in the main body casing 2, the front cover 4 of the main body casing 2 is first opened. Then, the rear edges of the flange portions 65 of the second side plates 53 of the drum unit 3 are brought into contact with the roller members (not shown) from above. Thereafter the drum unit 3 is moved rearward, whereby the flange portions 65 of the second side plates 53 slide on the roller members, and the drum unit 3 is guided into the main body casing 2. When the notch portions 71 (see FIG. 8) of the first side plates 22 come into contact with the main body reference shaft (not shown) extended on the rear side in the main body casing 2 over the width direction, further pressing of the drum unit 3 is regulated. Thus, the drum unit 3 is completely mounted in the main body casing 2.

E. Functions/Effects

As hereinabove described, the four photosensitive drums 5 are arranged in parallel with one another, and collectively retained by the first structure member 20 (the pair of first side plates 22) to be relatively positioned. The developer cartridges 7 are provided to individually correspond to the photosensitive drums 5 respectively. The developer cartridges 7 are collectively retained in the second structure member 21. The first structure member 20 is fixed to the second structure member 21 on the rear side in the anteroposterior direction, and mounted on the second structure member 21 on the front side in the anteroposterior direction with a clearance in the anteroposterior direction. Even if a difference in quantity of expansion/contraction is caused between the first structure member 20 and the second structure member 21 (the second side plates 53) due to a change in the temperature around the drum unit 3, therefore, the difference can be absorbed by the clearance of the first structure member 20 with respect to the second structure member 21. Consequently, the first structure member 20 can be prevented from deformation resulting from expansion/contraction of the second structure member 21, and the relative positional relation (a drum pitch) between the photosensitive drums 5 retained in the first structure member 20 can be kept constant.

The relative positional relation between the four developer cartridges 7 is not much important dissimilarly to the photosensitive drums 5, and hence the second structure member 21 retaining the developer cartridges 7 is so made of resin that the weight of the drum unit 3 as well as the material cost therefor can be reduced as compared with a case of employing a metal as the material for the second structure member 21.

Therefore, the relative positional relation between the four photosensitive drums 5 can be kept constant regardless of a change in the ambient temperature or the like, while the weight of the drum unit 3 and the material cost therefor can be reduced.

The first side plate bosses 76 of the second side plates 21 are fixed to the second boss holes 27 of the first side plates 22 in the vertical direction. Therefore, the first structure member 20 is fixed to the second structure member 21 in the vertical direction. Consequently, the first structure member 20 and the second structure member 21 can be prevented from a backlash in the vertical direction.

The side surfaces of the first structure member 20 and the second structure member 21 extend in the anteroposterior direction, and hence the difference in quantity of expansion/contraction in the anteroposterior direction caused between the first structure member 20 and the second structure member 21 is greater than the difference in quantity of expansion/contraction in the vertical direction caused between the first structure member 20 and the second structure member 21. The first structure member 20 is mounted on the second structure member 21 with the clearance in the anteroposterior direction, whereby the remarkable difference in quantity of expansion/contraction in the anteroposterior direction can be excellently absorbed due to the clearance. Consequently, the relative positional relation between the photosensitive drums 5 retained in the first structure member 20 can be kept constant.

The first structure member 20 includes the pair of first side plates 22. The pair of first side plates 22 are arranged to be opposed to each other in the width direction, and extend in the anteroposterior direction respectively. Both end portions of the photosensitive drums 5 are retained by the first side plates 22 respectively, so that the photosensitive drums 5 are extended between the pair of first side plates 22. The second structure member 21 is a frame body formed by the front beam 51, the rear beam 52 and the pair of second side plates 53. The second structure member is arranged so that the second side plates 53 are arranged to be opposed to the first structure member 20 (the first side plates 22) from outside in the width direction. The rear end portions of the first side plates 22 are held between the second side plates 53 and the rear beam 52. Thus, the first side plates 22 can be fixed to the second structure member 21 on the rear side in the anteroposterior direction. On the other hand, the front end portions of the first side plates 22 are interposed between the front beam 51 and the second side plates 53 while the gaps 91 are formed between the same and the second side plates 53 or the front beam 51. Thus, the first side plates 22 can be mounted on the second structure member 21 with clearances on the front side in the anteroposterior direction.

The first side plates 22 are made of a metal. Thus, expansion/contraction (deformation) of the first side plates 22 can be suppressed as compared with a case where the first side plates 22 are made of resin having a higher linear expansion coefficient than the metal. On the other hand, the second side plates 53 are made of resin. Thus, the material cost for the second side plates 53 can be suppressed as compared with a case where the second side plates 53 are made of a metal. Even if a difference in quantity of expansion/contraction is caused between the first side plates 22 made of a metal and the second side plates 53 made of resin due to the difference between the linear expansion coefficients of the metal and the resin, the difference can be absorbed through the clearances of the first side plates 22 with respect to the second structure member 21.

The first side plates 22 are formed by press working with the same press die. Therefore, the first side plates 22 can be formed with the same accuracy.

The drum subunits 6 retaining the scorotron chargers 8 are provided correspondingly to the photosensitive drums 5 respectively. The drum subunits 6 are extended between the pair of first side plates 22. Thus, the drum subunits 6 can be arranged with high positional accuracy with respect to the photosensitive drums 5. Therefore, the surfaces of the photosensitive drums 5 can be excellently charged with the scorotron chargers 8.

The four drum subunits 6 are extended between the pair of first side plates 22 so that the ladder-type structure is formed by the first side plates 22 and the four drum subunits 6, whereby the first side plates 22 can be kept parallel with each other.

The wire electrodes 38 and the grid electrodes 39 for feeding power to the scorotron chargers 8 are arranged on the right side surface of each drum subunit 6. Thus, power can be fed from the main body casing 2 to the scorotron chargers 8 through the wire electrodes 38 and the grid electrodes 39.

The antistatic light passing members 46 are provided correspondingly to the photosensitive drums 5 respectively. The antistatic light passing members 46 are extended between the pair of first side plates 22. Thus, the antistatic light passing members 46 can be arranged with high positional accuracy with respect to the photosensitive drums 5. Therefore, the light passed through the antistatic light passing members 46 can be excellently applied to the surfaces of the photosensitive drums 5, and charges can be excellently eliminated from the photosensitive drums 5.

The second side plates 53 are provided with the cartridge guide portions 72 for guiding attachment and detachment of the developer cartridges 7 to and from the second structure member 21. The developer cartridges 7 can be smoothly attached to and detached from the second structure member 21 through the cartridge guide portions 72. Further, the structure of the first side plates 22 can be simplified as compared with a case where the cartridge guide portions 72 are formed on the first side plates 22. Consequently, the working cost and the material cost for the first side plates 22 can be further reduced.

The detection light passing holes 78 are formed in the second side plates 53 to pass through the same in the width direction. The detection light passing holes 78 pass detection light for optically detecting the quantities of the toners in the developer cartridges 7 retained in the second structure member 21 respectively. The detection light passing holes 78 are so formed in the second side plates 53 that the structure of the first side plates 22 can be simplified as compared with a case where the detection light passing holes 78 are formed in the first side plates 22. Consequently, the working cost and the material cost for the first side plates 22 can be further reduced.

The developing electrodes 86 for feeding power to the developer cartridges 7 are arranged on the outer side surface (the right side surface) of the right second side plate 53 in the width direction. Thus, power can be fed from the main body casing 2 to the developer cartridges 7 through the developing electrodes 86.

The main body casing 2 is provided therein with the main-body-side developing electrodes 92 and the main-body-side charging electrodes 93 for pressing the first structure member 20 and the second structure member 21 leftward respectively. Even if the clearances 91 are formed between the first structure member 20 (the first side plates 22) and the second structure member 21 (the second side plates 53) in the width direction, therefore, the first structure member 20 and the second structure member 21 are so pressed leftward that the same can be arranged on positions relatively forming a constant positional relation and the drum unit 3 can be located on a constant position in the main boy casing 2 in the width direction when the drum unit 3 is mounted in the main body casing 2.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. A tandem type photosensitive unit configured to be detachably mounted in an apparatus body of an image forming apparatus, comprising:

a plurality of photosensitive drums arranged in parallel with one another;

a first structure member having a side surface extending in an arrangement direction of the photosensitive drums as viewed from an axial direction of the photosensitive drums, the first structure member being configured to position and retain each of the plurality of photosensitive drums; and a second structure member having a side surface extending in the arrangement direction as viewed from the axial direction, the second structure member being configured to retain a plurality of developer cartridges provided correspondingly to the photosensitive drums respectively, wherein the first structure member is fixed to the second structure member on one side of the second structure member, and mounted with a clearance on the other side of the second structure member relative to the arrangement direction, wherein the clearance at other side of the second structure member is configured to account for a difference in the expansion or contraction of the first structure member relative to the second structure member.

2. The tandem type photosensitive unit according to claim 1, wherein the first structure member is fixed to the second structure member in a direction orthogonal to both of the axial direction and the arrangement direction on the other side in the arrangement direction, and mounted with a clearance in the arrangement direction.

3. The tandem type photosensitive unit according to claim 2, wherein the first structure member includes:

a pair of first side plates arranged to be opposed to each other in the axial direction to extend in the arrangement direction respectively for holding both end portions of the photosensitive drums in the axial direction respectively, the second structure member includes:

a pair of second side plates arranged to hold the first structure member therebetween from outside in the axial direction while extending in the arrangement direction respectively;

a first beam member arranged on one side of the plurality of photosensitive drums in the arrangement direction and extended between the pair of second side plates; and a second beam member arranged on the other side of the plurality of photosensitive drums in the arrangement direction and extended between the pair of second side plates, and first end portions of the first side plates in the arrangement direction are held between the second side plates and the first beam member, and second end portions of the first side plates in the arrangement direction are interposed between the second beam member and the second side plates while clearances are formed between the same and the second side plates or the second beam member in the axial direction.

4. The tandem type photosensitive unit according to claim 3, wherein the first side plates are made of a metal, and the second side plates are made of resin.

5. The tandem type photosensitive unit according to claim 4, wherein the first side plates have the same shape.

6. The tandem type photosensitive unit according to claim 3, further comprising drum subunits provided correspondingly to the photosensitive drums respectively and extended between the pair of first side plates while retaining chargers for charging the surfaces of the photosensitive drums.

7. The tandem type photosensitive unit according to claim 6, wherein charging electrodes for feeding power to the chargers are arranged on first side surfaces of the drum subunits in the axial direction.

8. The tandem type photosensitive unit according to claim 3, further comprising antistatic light passing members provided correspondingly to the photosensitive drums respectively and extended between the pair of first side plates for passing antistatic light for eliminating charges from the photosensitive drums.

9. The tandem type photosensitive unit according to claim 3, wherein the second side plates are provided with cartridge guide portions for guiding attachment and detachment of the developer cartridges to and from the second structure member.

10. The tandem type photosensitive unit according to claim 3, wherein detection light passing holes passing detection light for optically detecting the quantities of developers in the developer cartridges when the developer cartridges are retained in the second structure member are formed in the second side plates penetratingly in the axial direction.

11. The tandem type photosensitive unit according to claim 3, wherein a developing electrode for feeding power to the developer cartridges is arranged on an outer side surface of one of the second side plates in the axial direction.

12. The tandem type photosensitive unit according to claim 1, wherein the second structure member includes:

a pair of second side plates arranged to hold the first structure member therebetween from outside in the axial direction while extending in the arrangement direction respectively.

13. The tandem type photosensitive unit according to claim 1, wherein the second structure member is configured to accommodate the first structure member retaining the plurality of photosensitive drums.

14. An image forming apparatus comprising:

an apparatus body; and a tandem type photosensitive unit configured to be detachably mounted in the apparatus body, wherein the tandem type photosensitive unit comprises:

a plurality of photosensitive drums arranged in parallel with one another;

a first structure member having a side surface extending in an arrangement direction of the photosensitive drums as viewed from an axial direction of the photosensitive drums, the first structure member being configured to position and retain each of the plurality of photosensitive drums; and a second structure member having a side surface extending in the arrangement direction as viewed from the axial direction, the second structure member being configured to retain a plurality of developer cartridges provided correspondingly to the photosensitive drums respectively, wherein the first structure member is fixed to the second structure member on one side of the second structure member, and mounted with a clearance on the other side of the second structure member relative to the arrangement direction, and wherein the other side of the second structure member is configured to provide a clearance which accounts for a difference in the expansion or contraction of first structure member relative to the second structure member.

15. The image forming apparatus according to claim 14, further comprising a pressing member provided in the apparatus body for pressing the first structure member and the second structure member toward one side in the axial direction respectively.

16. The image forming apparatus according to claim 14, wherein the second structure member includes:

a pair of second side plates arranged to hold the first structure member therebetween from outside in the axial direction while extending in the arrangement direction respectively.

17. The image forming apparatus according to claim 14, wherein the second structure member is configured to accommodate the first structure member retaining the plurality of photosensitive drums.

* * * * *